United States Patent [19]

Antipov et al.

[11] Patent Number: 4,811,797

[45] Date of Patent: Mar. 14, 1989

[54] IMPACT WRENCH

[75] Inventors: Georgy A. Antipov; Mikhail L. Gelfand; Boris G. Goldshtein; Gennady A. Korniliev, all of Moscow; Nikolai S. Lavnikov, Rostov-na-Donu; Yakov I. Tsipenjuk, Moscow; Petr S. Yakubovsky, Rostov-na-Donu, all of U.S.S.R.

[73] Assignee: Nauchno-Proizvodstvennoe Obiedinenie Po Mekhanizirovannomu Stroitelnomu Instrumentru I Otdelochnym Mashinam, Moscow, U.S.S.R.

[21] Appl. No.: 111,936

[22] Filed: Oct. 21, 1987

[51] Int. Cl.[4] ..... B25D 15/00

[52] U.S. Cl. ..... 173/93.6; 173/93

[58] Field of Search ..... 173/93.5, 93.6, 93

[56] References Cited

U.S. PATENT DOCUMENTS 3,175,660 3/1965 Kaman ..... 173/93.6

3,228,486 1/1966 Kaman et al. ..... 173/93.6

3,578,091 5/1971 States ..... 173/93.5 X

*Primary Examiner*—Frank T. Yost

*Assistant Examiner*—James L. Wolfe

*Attorney, Agent, or Firm*—Burgess, Ryan & Wayne

[57] ABSTRACT

An impact wrench has a casing accommodating rotatable anvil and shaft, the shaft supporting a hammer having a body with longitudinally extending passages in which pins are received for axial reciprocations which pins are engaged with the anvil in one position. A driving member received in an axial passage of the hammer body is coupled to the shaft to perform rotation and axial movement, the driving member being connected to the hammer body for rotation together therewith, and cooperating with a spring for moving the pins into a position, in which they are engaged with the anvil. The longitudinally extending passages open into the axial passage of the hammer body. Each pin has a bearing surface engageable with a respective bearing surface of the driving member during movement of the pins into the other position, the bearing surface being located on a portion of each pin protruding into the axial passage of the hammer body.

8 Claims, 5 Drawing Sheets

IMPACT WRENCH

FIELD OF THE INVENTION

The invention relates to tools designed for assembling and dismantling of various assemblies and mechanisms linked together by means of threaded joints, and in particular, it deals with hand-held power tools having a power drive and a means for imparting blows to a socket wrench, more specifically, with an impact wrench.

An impact wrench, according to the invention may be used in various industries for assembly and disassembly of threaded joints, e.g., in the mechanical engineering practice, in conveyor line assembly of motor vehicles, tractors and harvesting combines.

BACKGROUND OF THE INVENTION

Labour conditions, hence productivity and quality of assembly depend on mass, size, reliability and vibration level of an impact wrench.

An important part of an impact wrench is a hammer which transforms energy of a power drive into the work of tightening a threaded joint so as to ensure high labour productivity and desired tightening force.

An impact wrench is known in the art (SU, A, No. 180147), comprising a casing accommodating a rotatable anvil having a portion for the attachment of a socket wrench and a shaft coupled to a drive and supporting a hammer mounted to perform rotation and axial movement between two positions. Impact jaws are provided on the surfaces of the hammer and anvil facing towards one another, which engage one another in one of the hammer positions. The impact wrench also has a spring which is mounted in the casing coaxially with the shaft and cooperates with the hammer for moving it into the position, in which the hammer and anvil engage each other.

As the hammer must have a substantial mass which determines tightening torque of a threaded joint, vibrations of the impact wrench, which is so constructed, are very high because of the axial movement of the hammer, and this also entails unproductive energy consumption of the drive.

An impact wrench having a lower level of vibrations is also known in the art (U.S. Pat. No. 2,753,965). This impact wrench comprises a casing accommodating a rotatable anvil having a portion for the attachment of a socket wrench and a shaft coupled to a drive and supporting a hammer which has a body having one end thereof facing towards the anvil, an axial passage and at least two longitudinally extending passages, each accommodating a pin mounted to perform reciprocations between two positions, the pin being engaged with the anvil in one of these positions and having a bearing surface engageable, during the pin movement into the other position, with a respective bearing surface of a driving member which is coupled to the shaft to perform rotation and axial movement between two positions and which is connected to the hammer body for combined rotation, the driving member cooperating with a spring to move the driving member into a position, in which the pins are engaged with the anvil. The hammer body and driving member are mounted in tandem on the shaft. The driving member is guided by the shaft during movement. The driving member is in the form of a plate having two openings at the opposite ends thereof. The plate is rigidly connected to a hub for mounting the driving member on the shaft. The hammer body has an axial passage and two longitudinally extending passages parallel therewith. The axial passage diameter is determined by the diameter of the shaft, and the diameter of the longitudinally extending passage is determined by the diameter of the pin received therein, which diameter is chosen in accordance with the pin strength requirements depending on impact load. The distance between these passages is about equal to the pin diameter. It depends on the distance between the openings in the plate as one end of each pin is received in a respective opening of the plate. An annular groove is made at this end of the pin. The pin diameter at this point is equal to the width of the plate opening. One end face of the groove is a bearing surface engageable with one of the plate surfaces when the pin is moved into a position in which it is engaged with the anvil, the other end face of the groove being the other bearing surface of the pin engageable with the other surface of the plate when the pin moves into the other position.

This structural arrangement of the hammer, in which the driving member and the hammer body are mounted in tandem on the shaft results in their relative misalignment in operation and jamming, since the driving member is guided by the shaft and the pins are guided by the hammer body. Consequently, the pins are misaligned and jammed between the hammer body and bearing surfaces of the driving member.

In addition, misalignment of the driving member may cause breakage of the pins in the annular grooves.

All this constitutes the reason for failure of the impact wrench, lowers its reliability in operation and reduces service life.

The mass and size of the hammer and, in particular, of the hammer body are large enough since the distance between the openings of the driving member plate in which the pin ends are received should be greater than the overall dimension of the driving member hub, so that the size and mass of the impact wrench increase.

SUMMARY OF THE INVENTION

It is an object of the invention to provide an impact wrench which is more reliable in operation.

Another object of the invention is to reduce size of an impact wrench.

The above objects are accomplished by that in an impact wrench comprising a casing accommodating a rotatable anvil with a portion for the attachment of a socket wrench and a shaft coupled to a drive and supporting a hammer whose body has one end thereof facing towards the anvil, the hammer body being provided with an axial passage and at least two longitudinally extending passages each accommodating a pin mounted for axial reciprocations between two positions, the pin being engaged with the anvil in one position and having a bearing surface engageable, during the pin movement into the other position, with a respective bearing surface of the driving member which is coupled to the shaft so as to perform rotation and axial movement between two positions and which is coupled to the hammer body for rotation together therewith and cooperates with a spring for moving the driving member into a position in which the pins are engaged with the anvil, according to the invention, the longitudinally extending passages open into the axial passage of the hammer body, and the driving member is received in, and guided by, the axial passage during movement, each pin having a portion protruding into the axial passage of the hammer body, the bearing surface of the pin being provided on this portion of the pin.

To reduce wear of the anvil and pins, the impact wrench according to the invention has auxiliary springs, the number of springs corresponding to the number of the pins, each spring being mounted in the longitudinally extending passage between the pin and the end of the hammer body opposite to the end thereof facing towards the anvil so as to press the bearing surfaces of the pins against the bearing surfaces of the driving member during their movement.

According to the invention, an axial hole is made at the end of each pin and a headed rod is received in the axial hole, the auxiliary spring being provided between the rod head and the end face of the pin, the driving member having auxiliary bearing surfaces engageable with the heads of the respective rods.

To lower force of the main spring, the impact wrench according to the invention has a washer mounted at the end of the hammer body opposite to the end thereof facing towards the anvil, each auxiliary spring having one end thereof bearing against the end face of a respective pin and the other end bearing against the washer.

To lower stresses developing in the pins at the moment of blow upon engagement thereof with the anvil, a portion of the longitudinally extending passage is made enlarging or flaring in the direction towards the end of the hammer body facing towards the anvil.

Mounting the driving member in the axial passage of the hammer body substantially prevents the pins from being jammed between the driving member and hammer body since both the pins and driving member are guided by one and the same part - hammer body. This structural arrangement of the hammer prevents the pins from being jammed in the longitudinally extending passages of the hammer body so as to improve reliability and prolong service life of the impact wrench by about 20 to 30% as compared with conventional tools. With this construction of the hammer the moment of inertia which is necessary for tightening a threaded joint is achieved with a lower mass of the hammer thus lowering mass and size of the impact wrench.

An important advantage of the impact wrench according to the invention is reduced vibration as compared with conventional impact wrenches owing to reduced size and lower mass of the hammer members performing reciprocations and also owing to the employment of auxiliary springs in the hammer to limit the pin movement with respect to the driving member.

Reliability of the impact wrench is also improved owing to the fact that pin breakage at the moment of blow upon engagement with the anvil is less likely.

DESCRIPTION OF THE DRAWINGS

The invention will now be described with reference to specific embodiments thereof illustrated in the accompanying drawings, in which.

DESCRIPTION OF THE PREFERRED EMBODIMENTS

Figure 1:
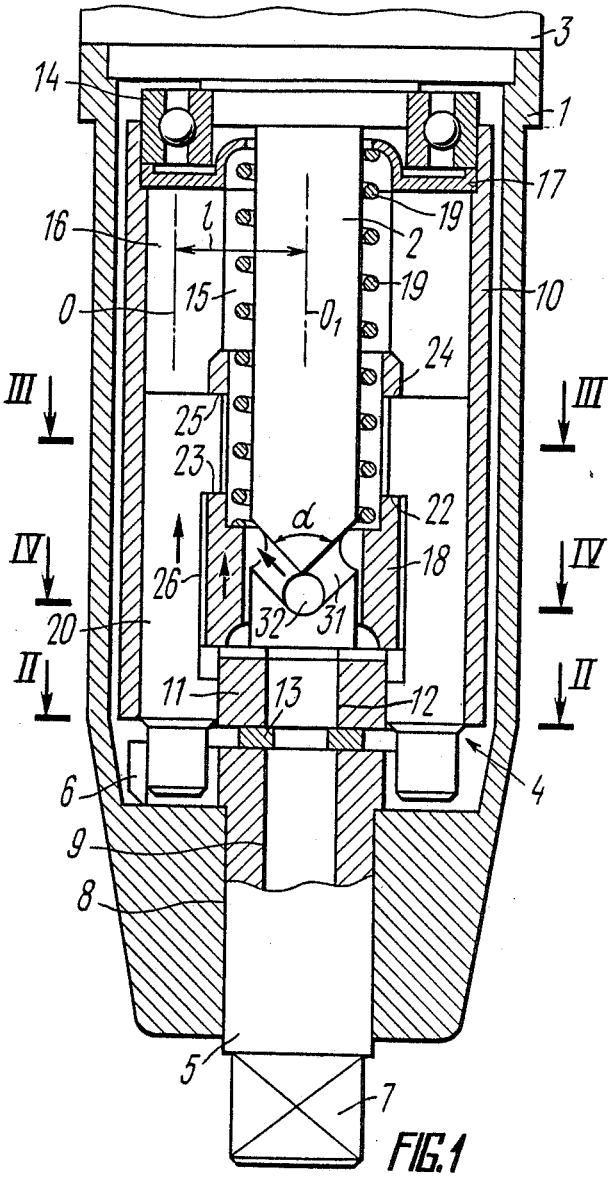
FIG. 1 is a general longitudinal sectional view of an impact wrench according to the invention.

An impact wrench according to the invention (FIG. 1) comprises a casing 1 accommodating an axially extending shaft 2 mounted in the casing 1 for rotation. One end of the shaft 2 is coupled to a drive 3 (only a part of the drive is shown in the drawing). A portion of the shaft 2 on the side of the free end thereof has a reduced diameter. A hammer 4 and an anvil 5 are disposed in the casing 1 coaxially with the shaft 2. The anvil 5 has a flange 6 at one end and a portion 7 at the other end which protrudes outside the casing 1 and is designed for the attachment of a socket wrench (not shown). The anvil 5 is journalled in the casing 1, its flange 6 bears against the casing 1, and the intermediate portion thereof passes freely through a hole 8 of the casing 1. The anvil 5 has a bore 9 receiving the free end of the shaft 2.

The hammer 4 has a hammer body 10 having one end thereof facing towards the anvil 5. The hammer body 10 comprises a cylinder which is mounted in the casing 1 in such a manner that its end 11 faces towards the anvil 5. The mass of the hammer body 10 is chosen in accordance with output torque of the impact wrench. The hammer body 10 is journalled on the shaft 2. For that purpose, a hole 12 is made in the end 11 of the hammer body 10 to receive the reduced diameter portion of the shaft 2.

To prevent the hammer body 10 from axially moving, a retaining ring 13 is provided between the end 11 of the hammer body 10 and the anvil 5, on the shaft 2.

A bearing 14 is mounted on the opposite end of the shaft 2 facing towards the drive, and the other end of the hammer body 10 bears against this bearing. The hammer body 10 has an axial passage 15 and two diametrically opposed longitudinally extending passages 16 having their axes "O" extending in parallel with the axis "$O_1$" of the central or axial passage 15. The longitudinally extending passages 16 open into the axial passage 15, i.e. their axes "O" are spaced from the axis "$O_1$" of the axial passage 15 at such a distance "l" that a common interior space is defined inside the hammer body 10. A washer 17 covering this interior space of the hammer body 10 is mounted at this end of the hammer body 10. A driving member 18 in the form of a bushing and a compression spring 19 are disposed in the axial passage 15 of the hammer body 10. One end of the spring 19 bears against the driving member 18 and the other end thereof bears against the washer 17.

In another embodiment of the impact wrench the spring 19 may bear with the same end against the shaft 2 or bearing 14.

The driving member 18 is received in, and guided by, the axial passage 15 of the hammer body 10, and for that purpose the radial clearance between the hammer body 10 and outer periphery of the driving member 18 should be the minimum possible for free axial displacement of the driving member 18 in the axial passage 15 of the hammer body 10.

A pin 20 is received in each longitudinally extending passage 16. The pin 20 is mounted for axial movement between two positions.

Figure 2:
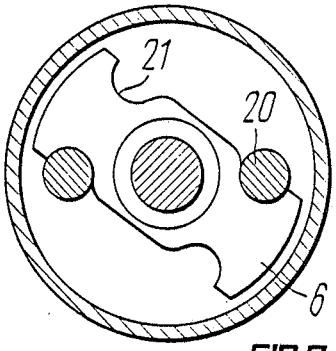
FIG. 2 is a sectional view taken along line II—II in FIG. 1, according to the invention.

FIG. 1 shows a position in which the pins 20 are engaged with the anvil 5. The ends of the pins are received in recesses 21 (FIG. 2) of the flange 6 of the anvil 5. Each pin 20 has a bearing surface 22 (FIG. 1) engageable with a respective bearing surface 23 of the driving member 18 during movement of the pin 20 into the other position in which the pins 20 are disengaged from the anvil 5.

Each pin 20 has a portion protruding into the axial passage 15 of the hammer body 10, and the bearing surface 22 of the pin 20 is located on this portion.

Figure 3:
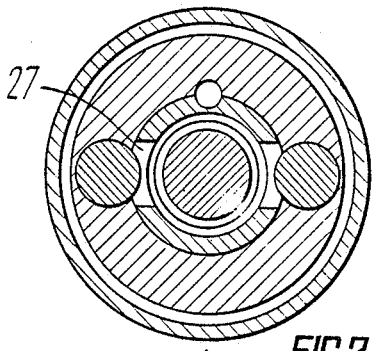
FIG. 3 is a sectional view taken along line III—III in FIG. 1 (a spring is not shown), according to the invention.

In addition, to enable the pin 20 to engage the driving member 18 during movement of the pin 20 into the position in which it is engaged with the anvil 5, the pin has a second bearing surface 24 engageable with a bearing surface 25 of the driving member 18. A flat 26 is made in the intermediate part of the pin 20 to define at the ends of the pin shoulders disposed in the axial passage 15 of the hammer body 10. The end face of one of the shoulders defines the bearing surface 22. The bearing surface 24 is defined by the end face of the pin 20 facing towards the washer 17. The bearing surfaces 22 and 24 may be provided, e.g. on pins mounted in the periphery of the pins and rigidly secured thereto (not shown in the drawings). Grooves 27 (FIG. 3) are made in the driving member 18, and the end faces of these grooves define the bearing surfaces 23 and 25 of the driving member.

Figure 4:
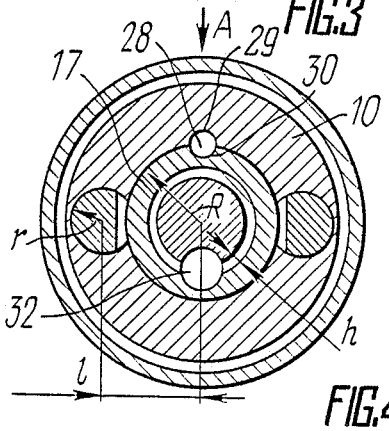
FIG. 4 is a sectional view taken along line IV—IV in FIG. 1, according to the invention.

The axial and longitudinally extending passages 15 and 16, respectively, are circular in the cross-section, with radii R and r, respectively (see FIG. 4). To define a common interior space inside the hammer body 10, the distance "l" between the axes "O" and "$O_1$" should be smaller than the sum of the radii thereof, i.e. $l<R+r$. In this embodiment this distance is about $\frac{1}{3}$ r smaller than the sum of the radii R and r. The value of the distance "l" also depends on the cross-sectional configuration of the passages 15 and 16. They may be in the form of a regular polygon, e.g. hexagon. In such a case, the distance "l" between the axes "O" and "$O_1$" should be smaller than the sum of radii of the inscribed circles.

The driving member 18 (FIG. 1) is coupled to the shaft 2 for rotation and for axial movement between two positions and is connected to the hammer body 10 for rotation together therewith. The driving member is connected to the hammer body 10 by means of a key 28 (FIG. 4). The key 28 is disposed between the hammer body 10 and the driving member 18 in respective keyways 29 and 30. The length of the keyway 30 in the driving member 18 is equal to the length of the key 28, whereas the length of the keyway 29 in the hammer body 10 should be such as to allow the driving member 18 the necessary amount of movement in the axial direction. A clearance "h" between the inner surface of the driving member 18 and the shaft 2 should be such as to preclude any contact between the driving member 18 and shaft 2.

Two helical grooves 31 are made in the shaft 2 (FIG. 1) intersecting each other at an angle $\alpha$, each groove serving as a guide for movement of a ball 32 received between the shaft 2 and driving member 18, depending on direction of rotation.

A recess 33 (FIG. 5) is made in the inner surface of the driving member 18, the outlines of the recess being defined by two helical lines intersecting each other at an angle $\alpha_1=\alpha$, and by an end face of the driving member 18.

The helical lines along which the grooves 31 extend are directed towards the drive 3 from their intersection point, and the driving member 81 is mounted on the shaft 2 in such a manner that the helical lines outlining the recess 33 extend in the opposite directions, the ball 32 received between the driving member 18 and the shaft 2 having a part thereof received in the recess 33 of the driving member 18, and the remaining part received in the groove 31 (FIG. 1).

Figure 6:
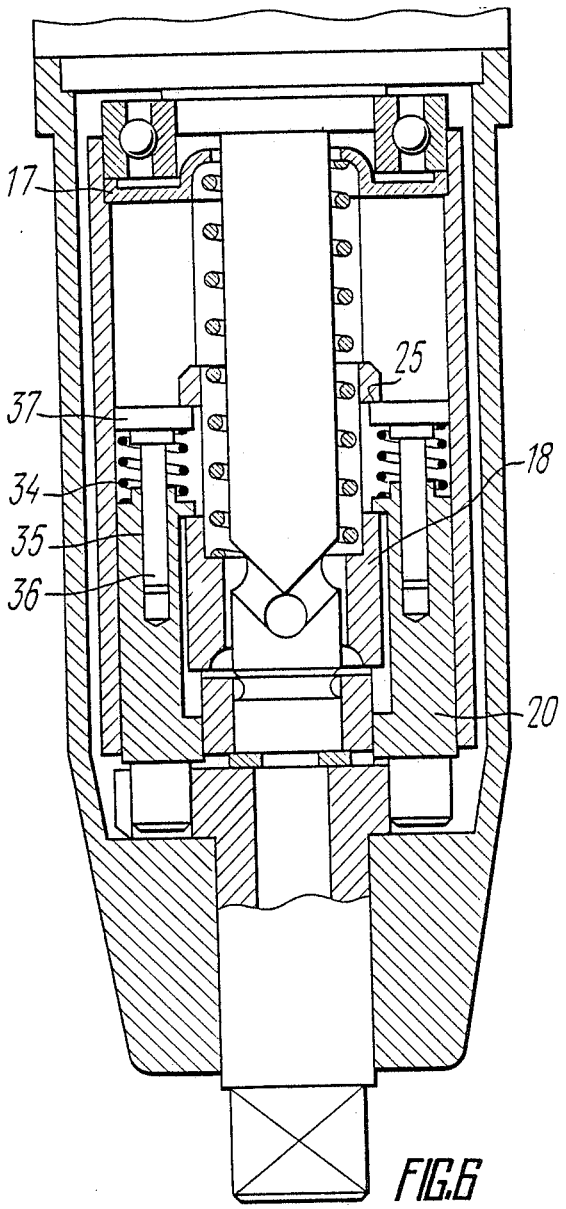
FIG. 6 is a general longitudinal sectional view of an impact wrench having auxiliary springs each received in a respective longitudinally extending passage of the hammer body between a pin and rod head, according to the invention.

To reduce wear of the pins 20 at the moment of blow, the impact wrench shown in FIG. 6 has two auxiliary compression springs 34, the number of the springs corresponding to the number of the pins 20. The auxiliary springs 34 are designed for pressing the bearing surfaces 22 of the pins 20 against the bearing surfaces 23 of the driving member 18. For that purpose, an axial hole 35 is made in the end of each pin 20 facing towards the washer 17, and a rod 36 having a head 37 is received for axial movement in this hole. The auxiliary spring 34 is mounted coaxially with the rod 36, between its head 37 and the end face of the pin 20. The end face of the head 37 is the bearing surface of the pin 20 engageable with the bearing surface 25 of the driving member 18.

Figure 7:
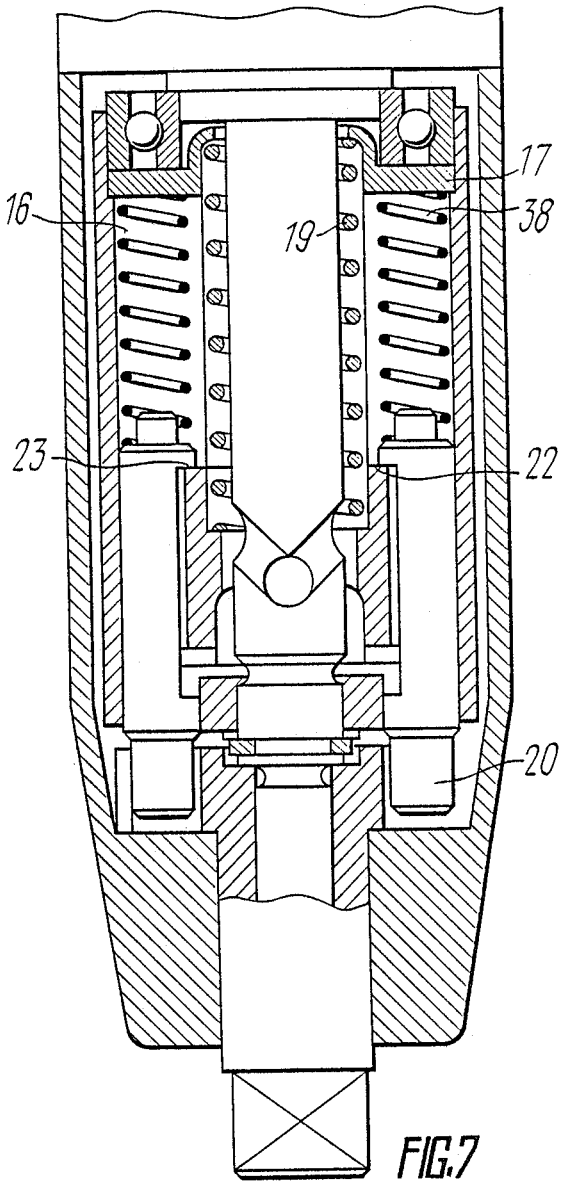
FIG. 7 is a general longitudinal sectional view of an impact wrench having auxiliary springs each received in a longitudinally extending passage of the hammer body between a pin and washer, according to the invention.

In the impact wrench shown in FIG. 7 two auxiliary springs 38 are received in the longitudinally extending passages 16, each spring having one end thereof bearing against the end face of the pin 20, the other end bearing against the washer 17. The pin 20 has one bearing surface 22 engageable with the respective bearing surface 23 of the driving member 18. In this embodiment, when the spring 19 acts upon the driving member 18, the force of this spring adds up to the force of the auxiliary springs 38 so as to lower the force of the main spring 19.

In any position of the pins 20, the auxiliary springs 38 will permanently press the bearing surfaces 22 of the pins 20 against the respective bearing surfaces 23 of the driving member 18.

Figure 8:
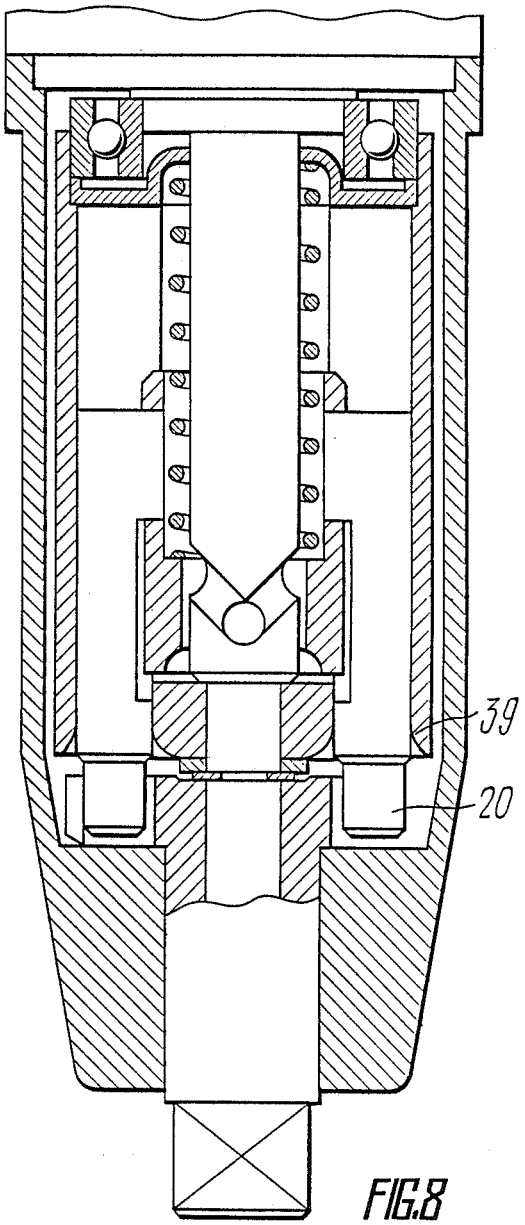
FIG. 8 is a general longitudinal sectional view of an impact wrench having longitudinally extending passages of the hammer body which flare in the direction towards the end of the hammer body, according to the invention.

FIG. 8 shows an impact wrench in which a portion 39 of the longitudinally extending passage 16 of the hammer body 10 is made enlarging or flaring in the direction towards the end of the hammer body 10 facing towards the anvil 5 so as to lower stresses in the pins 20 at the moment of blow upon engagement with the anvil 5. This portion 39 may be funnel-shaped, the length of the portion 39 of the passage 16 being a maximum two times the diameter of the pin 20 and at least equal to the radius of the pin 20.

The portion 39 of the passage 16 may be elliptical in the cross-section, elongated in the direction of rotary blow (not shown in the drawing).

The difference between the diameters of the main portion and the flaring portion 39 of the longitudinally extending passage 16 should be such as to lower internal stresses in the pin 20 under the action of impact loads to values preventing the pin from being broken.

The impact wrench according to the invention functions in the following manner. First a socket wrench is put on the portion 7 of the anvil (FIG. 1) (not shown). The driving member 18, spring 19 and ball 32 are in the positions shown in FIG. 1 in which the pins 20 are engaged with the anvil 5.

Figure 5:
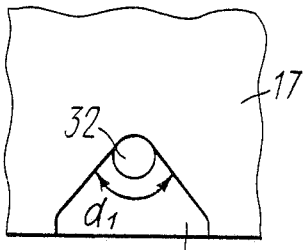
FIG. 5 is a view taken along arrow A in FIG. 4 showing a part of the inner surface of a driving member in a developed view at point where it connects to the shaft.

Then the socket wrench (which is not shown) is applied to a nut (not shown) of a threaded joint, and the drive 3 is turned on for tightening the threaded joint. Troque is transmitted from the drive 3 through the shaft 2, ball 32, driving member 18, and key 28 (FIG. 4) to the hammer body 10 (FIG. 1) and further, through the pins 20 and anvil 5, to the socket wrench which will run down the nut of the threaded joint. As the nut is being run-down, resistance to its rotation increases, and the anvil 5 is braked so that the hammer 4 is stopped. The shaft 2 continues to rotate, and the ball 32 starts rolling in its groove 31 to push the driving member 18 while moving along the recess 33 (FIG. 5).

The driving member 18 starts moving in the axial passage 15 of the hammer body 10 in the direction away from the anvil 5, and the key 28 will slide along the keyway 29 of the hammer body 10 (FIG. 4). During its movement, the driving member 18 bears with its bearing surfaces 23 against the bearing surfaces 22 of the pins 20 to push them and to move them out of engagement with the anvil 5. At the same time, the driving member 18 will compress the spring 19 during its axial movement. Therefore, the kinetic energy of rotation of the shaft 2 is transformed into potential energy of compressed spring 19. When the pins 20 leave the recesses 21 of the anvil 5 (FIG. 2), the driving member 18 and hammer body 10 (FIG. 1) will start rotating together with the shaft 2, but the driving member 18 will continue to move in the same direction by inertia until its rotation velocity becomes equal to that of the shaft 2.

Then the spring 19 will cause the driving member 18 and pins 20 to move in the opposite direction into the initial position. The driving member 18 will have its bearing surfaces 24 bearing against the bearing surfaces 23 of the pins 20 to push the pins 20 to the initial position until they come in engagement with the anvil 5. The potential energy of the spring 19 will be thus transformed into the kinetic energy of the hammer 4.

Upon engagement, the pins 20 will deliver a blow to the anvil 5 so that the full kinetic energy of the hammer 4 will be transmitted through the anvil 5 into the threaded joint where it will be transformed into work of its tightening. Subsequently, as long as the drive 3 is energized, the blows will be repeated at regular intervals to complete tightening of the threaded joint, the impact wrench functioning as described above.

The impact wrench shown in FIG. 6 functions in a similar manner, with the only difference that when the hammer 4 moves back to the initial position, i.e. to a position in which the pins 20 are engaged with the anvil 5, the bearing surfaces 24 of the driving member 18 bearing against the heads 37 will push the pins 20 back to the initial position until they come in touch with the flange 6 of the anvil 5. The driving member 18, hammer body 10, and pins 20 will continue to rotate, and the driving member 18 will continue to move axially in the axial passage 15 of the hammer body 10 to compress the auxiliary springs 34 thus damping the blow of the pins 20 against the anvil 5. In this case the bearing surfaces 22 and 23 of the pins 20 and driving member 18, respectively, will engage one another, and the ends of the pins 20 facing towards the anvil 5 will slide over the surface of the flange 6. This will continue until they are received in the recesses of the anvil 5. The springs 34 will then expand to press the bearing surfaces 22 of the pins 20 against the bearing surfaces 23 of the driving member 18. For the rest, the impact wrench functions in the same manner as that shown in FIG. 1.

The impact wrench shown in FIG. 7 functions in the same manner as that shown in FIG. 1, with the only difference that when the hammer 4 moves back to the initial position in which the pins 20 are engaged with the anvil 5, the auxiliary springs 38 will press the bearing surfaces 22 of the pins 20 against the bearing surfaces 23 of the driving member 18 and will push the pins 20 in the direction towards the anvil 5 until they come in touch with the flange 6 so as to dampen the blow upon engagement with the anvil 5. The driving member 18, hammer body 10 and pins 20 will continue to rotate, the pins 20 will slide over the surface of the flange 6 until their ends are received in the recesses of the anvil 5. The springs 38 will then expand to press the bearing surfaces 22 of the pins 20 against the bearing surfaces 23 of the driving member 18. For the rest, the impact wrench will function similarly to that shown in FIG. 1.

The impact wrench shown in FIG. 8 functions in the same manner as that shown in FIG. 1, with the only difference that at the moment of the blow transmitted by the pin 20 to the anvil 5, the end of the pin, which is received in the flaring portion 39 of the longitudinally extending passage 16, will be bent in the direction of the rotary blow so as to lower the internal stresses developing in the pins 20 at the moment of blow and to prevent them from being broken.

We claim:

1. An impact wrench, comprising:

a casing;

an anvil rotatably mounted in said casing and having a portion for the attachment of a socket wrench;

a shaft rotatably mounted in said casing;

a drive coupled to said shaft to impart rotation thereto;

a hammer mounted in said casing;

a body of said hammer;

an axial passage in said hammer body;

at least two longitudinally extending passages in said hammer body, opening into said axial passage;

an end of said hammer body facing towards an anvil;

pins of said hammer, each pin being received in said longitudinally extending passage for axial reciprocation between a position, in which the pins are engaged with an anvil, and a position, in which said pins are disengaged from said anvil;

a driving member of said hammer, said driving member being received in said axial passage of the hammer body and coupled to said shaft so as to perform rotation and axial movement between two positions;

said driving member being guided in said axial passage of each said hammer body;

a bearing surface of each said driving member;

a portion of said pin protruding into said axial passage of said hammer body;

a bearing surface of said pin, said bearing surface being located on said portion protruding into said axial passage of said hammer body so as to engage said bearing surface of said driving member during its movement into a position, in which said pins are disengaged from the anvil;

a spring disposed in said casing and adapted to cooperate with said driving member for moving it into a position, in which said pins are engaged with said anvil.

2. An impact wrench, comprising:

a casing;

an anvil rotatably mounted in said casing and having a portion for the attachment of a socket wrench;

a shaft rotatably mounted in said casing;

a drive coupled to said shaft to impart rotation thereto;

a hammer mounted in said casing;

a body of said hammer;

an axial passage in said hammer body;

at least two longitudinally extending passages in said hammer body, opening into said axial passage;

an end of said hammer body facing towards said anvil;

pins of said hammer each pin being received in said longitudinally extending passage for axial reciprocation between a position, in which the pins are engaged with said anvil, and a position, in which said pins are disengaged from said anvil;

a driving member of said hammer received in said axial passage of the hammer body and coupled to said shaft so as to perform rotation and axial movement between two positions;

said driving member being guided in said axial passage of said hammer body;

a bearing surface of each said driving member;

a portion of said pin protruding into said axial passage of each said hammer body;

a bearing surface of said pin, said bearing surface being located on said portion protruding into said axial passage of said hammer body so as to engage said bearing surface of said driving member during its movement to a position in which said pins are disengaged from said anvil;

a plurality of springs in said casing, one spring adapted to cooperate with said driving member for moving it to a position, in which said pins are engaged with said anvil, and the other springs, the number of which corresponds to the number of said pins, being received in said longitudinally extending passages of said hammer body, between said pin and the end of said hammer body opposite to said end thereof facing towards the anvil to press said bearing surfaces of said pins against said bearing surfaces of said driving member during their movement.

3. An impact wrench according to claim 2, comprising:

an axial hole in the end of each of said pins;

a rod axially traversable in said axial hole of said pin;

a head of said rod;

each of said springs received in said longitudinally extending passages being mounted on said rod, between said head thereof and the end face of said pin;

auxiliary bearing surfaces of said driving member, said auxiliary bearing surfaces being engageable with said heads of said rods.

4. An impact wrench according to claim 2, comprising:

a washer mounted on the end of said hammer body opposite to said end thereof facing towards the anvil;

each of said springs received in said longitudinally extending passages of said hammer body bearing against the end of said pin and against said washer.

5. An impact wrench, comprising:

a casing;

an anvil rotatably mounted in said casing and having a portion for the attachment of a socket wrench;

a shaft rotatably mounted in said casing;

a drive coupled to said shaft to impart rotation thereto;

a hammer mounted in said casing;

a body of said hammer;

an end of said hammer body facing towards said anvil;

an axial passage in said hammer body;

at least two longitudinally extending passages in said hammer body, opening into said axial passage;

a portion of each of said longitudinally extending passages of said hammer body flaring towards said end of said hammer body, facing towards said anvil;

pins of said hammer, each pin being received in said longitudinally extending passage for axial reciprocation between a position, in which they are engaged with said anvil, and a position, in which said pins are disengaged from said anvil;

a driving member of said hammer received in said axial passage of said hammer body and coupled to said shaft so as to perform rotation and axial movement between two positions;

said driving member being guided in said axial passage of said hammer body;

a bearing surface of said driving member;

a portion of each said pin protruding into said axial passage of said hammer body;

a bearing surface of each said pin, said bearing surface being located on said portion protruding into said axial passage of said hammer body so as to engage said bearing surface of said driving member during its movement into a position in which said pins are disengaged from said anvil;

a spring mounted in said casing and adapted to cooperate with said driving member for moving it into a position, in which said pins are engaged with said anvil.

6. An impact wrench comprising:

a casing;

an anvil rotatably mounted in said casing and having a portion for the attachment of a socket wrench;

a shaft rotatably mounted in said casing;

a drive coupled to said shaft to impart rotation thereto;

a hammer mounted in said casing;

a body of said hammer;

an end of said hammer body facing towards said anvil;

an axial passage in said hammer body;

at least two longitudinally extending passages in said hammer body, opening into said axial passage;

a portion of each of said longitudinally extending passages flaring towards said end of said hammer body facing towards said anvil;

pins of said hammer, each pin being received in said longitudinally extending passage for axial reciprocation between a position in which they are engaged with said anvil, and a position, in which said pins are disengaged from said anvil;

a driving member of said hammer received in said axial passage of said hammer body and coupled to said shaft so as to perform rotation and axial movement between two positions;

said driving member being guided in said axial passage of said hammer body;

a bearing surface of said driving member;

a portion of each said pin protruding into said axial passage of said hammer body;

a bearing surface of each said pin, said bearing surface being located on said portion protruding into said axial passage of said hammer body so as to engage said bearing surface of said driving member during its movement into a position, in which said pins are disengaged from said anvil;

a plurality of springs in said casing, one of the springs adapted to cooperate with said driving member for moving it into a position, in which said pins are engaged with said anvil, the other springs, the number of which corresponds to the number of said pins, being received in said longitudinally extending passages of said hammer body, between said pin and the end of said hammer body opposite to said end thereof facing towards said anvil to press said bearing surfaces of said pins against said bearing surfaces of said driving member during their movement.

7. An impact wrench according to claim 6, comprising:

an axial hole in the end of each of said pins;

a rod axially traversable in said axial hole of said pin;

a head of said rod;

each of said springs received in said longitudinally extending passages being mounted on said rod, between said head thereof and the end face of said pin;

auxiliary bearing surfaces of said driving member, said auxiliary bearing surfaces being engageable with said heads of said rods.

8. An impact wrench according to claim 6, comprising:

a washer mounted on the end of said hammer body opposite to said end thereof facing towards said anvil;

each of said springs received in said longitudinally extending passages of said hammer body bearing against the end face of a respective pin and against said washer.

* * * * *